US005313035A

United States Patent [19]

Chartrain et al.

[11] Patent Number: 5,313,035

[45] Date of Patent: May 17, 1994

[54] DOOR FOR HOUSEHOLD ELECTRIC OVEN

[75] Inventors: Pierre Chartrain, Soliers Bourguebus; Michel G. de Matteis, Cambes-En-Plaine; Bernard M. Bois, Caen, both of France

[73] Assignee: Moulinex (Societe Anonyme), Bagnolet, France

[21] Appl. No.: 822,987

[22] Filed: Jan. 21, 1992

[30] Foreign Application Priority Data

Jan. 25, 1991 [FR] France ..... 91 00847

[51] Int. Cl.[5] ..... H05B 6/76; F24C 15/02

[52] U.S. Cl. ..... 219/740; 126/200

[58] Field of Search ..... 219/10.55 D, 10,55 E, 219/10.55 R; 126/190, 200

[56] References Cited

U.S. PATENT DOCUMENTS

| | | | |
|---|---|---|---|
| 2,394,176 | 2/1946 | Hillebrand . | |
| 2,877,761 | 3/1959 | Schibley | 126/200 |
| 3,388,698 | 6/1968 | Satkunas . | |
| 3,408,785 | 11/1968 | Kochanowski | 126/200 |
| 3,565,054 | 2/1971 | Smith et al. | 126/200 |
| 4,054,768 | 10/1977 | White et al. | 219/10.55 D |
| 4,206,338 | 6/1980 | Katona | 219/10.55 D |
| 4,211,910 | 7/1980 | Kusunoki et al. | 219/10.55 D |
| 4,577,079 | 3/1986 | Sutaku | 219/10.55 D |

FOREIGN PATENT DOCUMENTS 191803 11/1937 France .

*Primary Examiner*—Philip H. Leung

*Attorney, Agent, or Firm*—Young & Thompson

[57] ABSTRACT

The door of an oven comprises a shell (1) of parallelepipedal shape whose front wall (2) has a large opening having the shape of a parallelogram enclosed by a transparent plate (3). The securement of the transparent plate (3) on the shell (1) is effected by fixation members which are formed by holding tongues ($P_1$ to $P_8$) arranged respectively on two opposite sides (9 and 10) of the edge (4) of the opening of the shell, while the transparent plate (3) has two opposite sides (24 and 25) bearing projections ($S_1$ to $S_8$) adapted to come into securement, by sliding, respectively beneath the holding tongues ($P_1$ to $P_8$). For use in all the doors of household electric ovens.

6 Claims, 5 Drawing Sheets

DOOR FOR HOUSEHOLD ELECTRIC OVEN

FIELD OF THE INVENTION

The present invention relates to doors for domestic electric ovens comprising a shell of parallelepipedal shape whose front wall has a large opening having the shape of a parallelogram and closed by a transparent plate.

BACKGROUND OF THE INVENTION

The securement of said transparent plate on said shell is generally effected by securement members independent of the two elements to be assembled. The securement elements used are generally devices comprising securement screws and nuts requiring supplemental accessories during assembly or tongues welded with the interposition of joints.

Moreover, the securement members are difficult to emplace and require long mounting times.

The object of the invention is to overcome the recited drawbacks by providing a new concept of a door for a household electric oven and by practicing a simple procedure for mounting the transparent plate on the opening of the parallelepipedal shell.

SUMMARY OF THE INVENTION

According to the invention, the door for a household electric oven is characterized in that the securement members are formed by at least two holding tongues provided respectively on two opposite sides of the inner edge and located each a slight distance from this edge so as to define a recess open in the direction of the opening, while the transparent plate comprises on two opposite sides which are parallel to the two sides bearing the tongues, at least two projections adapted to become secured, by sliding of the plate relative to the inner edge, respectively under the two holding tongues, the inner edge and the plate comprising mutual blocking means.

Thanks to this door for a household electric oven according to the invention, the number of pieces necessary for the securement of the transparent plate in the opening of the parallelepipedal shell is limited to the two members, which simplifies mounting and reduces the assembly time of the two members as well as the cost of assembly and of fabrication of the door of the household electric oven.

BRIEF DESCRIPTION OF THE DRAWINGS

The characteristics and advantages of the invention will further appear from the description which follows, by way of example, with reference to the accompanying drawings, in which.

DETAILED DESCRIPTION OF THE INVENTION

Figure 1:
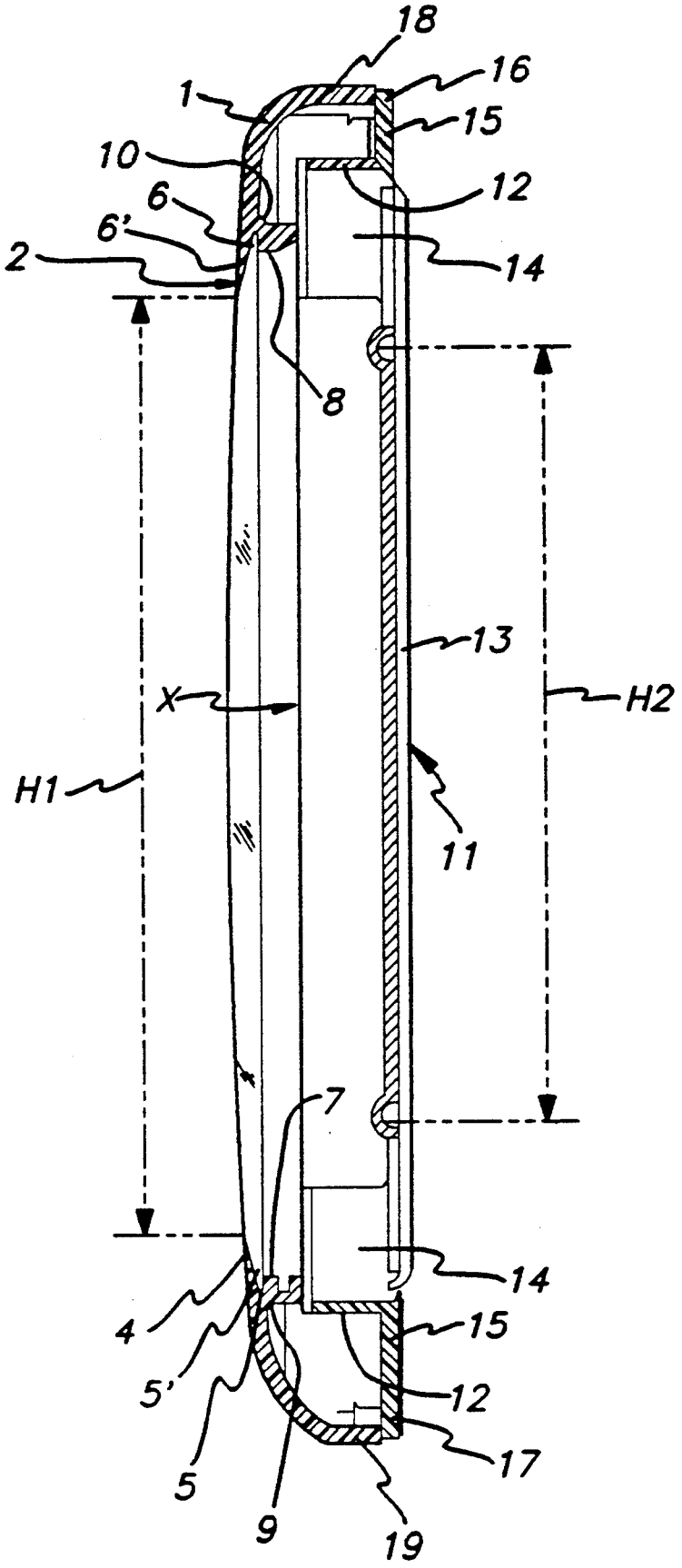
FIG. 1 shows a transverse cross section of a door for a household electric oven according to the invention.

According to FIG. 1, a door of a microwave oven comprises a shell 1, for example of plastic material of generally parallelepipedal form and rectangular profile whose front wall 2 has a large opening X of a height $H_1$ which has the general shape of a rectangular parallelogram and which is closed by a transparent plate 3, for example of polycarbonate, of a shape complementary to and mounted on the inner edge 4 of the opening. The transparent plate 3 comprises projections 5 and 6 which are disposed in open recesses 5' and 6' defined by the spacing provided between the inner edge 4 and securement members constituted, for example, by holding tongues 7, 8 and located respectively on two opposite sides 9 and 10 of the inner edge 4. The shell 1 and the transparent plate 3 have, in vertical cross section transverse to the sides bearing the holding tongues 7, 8 and the projections 5, 6, a profile which is outwardly rounded.

The rear portion 11 of the door of the microwave oven comprises moreover a metallic frame 12 positioned, for example, removably secured on the shell 1. The frame 12 has a generally parallelepipedal shape and has a large opening of height $H_2$ which has the general shape of a parallelogram and which is closed by a perforated metal plate 13. The perforated plate has holes located equal distances from each other so as to prevent the passage of waves from the cooking chamber when the oven, whose door has previously been closed, is in the microwave operational mode, and securement means permitting easy attachment of the perforated metal plate 13 on the armature 12. The metallic frame 12 also comprises, on its periphery, a cut-out 14 corresponding to a quarter-wave trap of known type permitting capturing escaping waves when the door is closed, thereby avoiding any risk of escape of waves to the outside of the oven.

A frame 15, for example of plastic material, of generally parallelepipedal shape is positioned, for example by a removable securement, on the metallic frame 12 such that opposite sides 16 and 17 of the frame 15 come respectively into contact with a lower edge 18 of the shell 1 and bear against an upper edge 19 of the shell 1. The fitting of the different recited elements permits the rear portion 11 of the door to have a flat surface.

Figure 2:
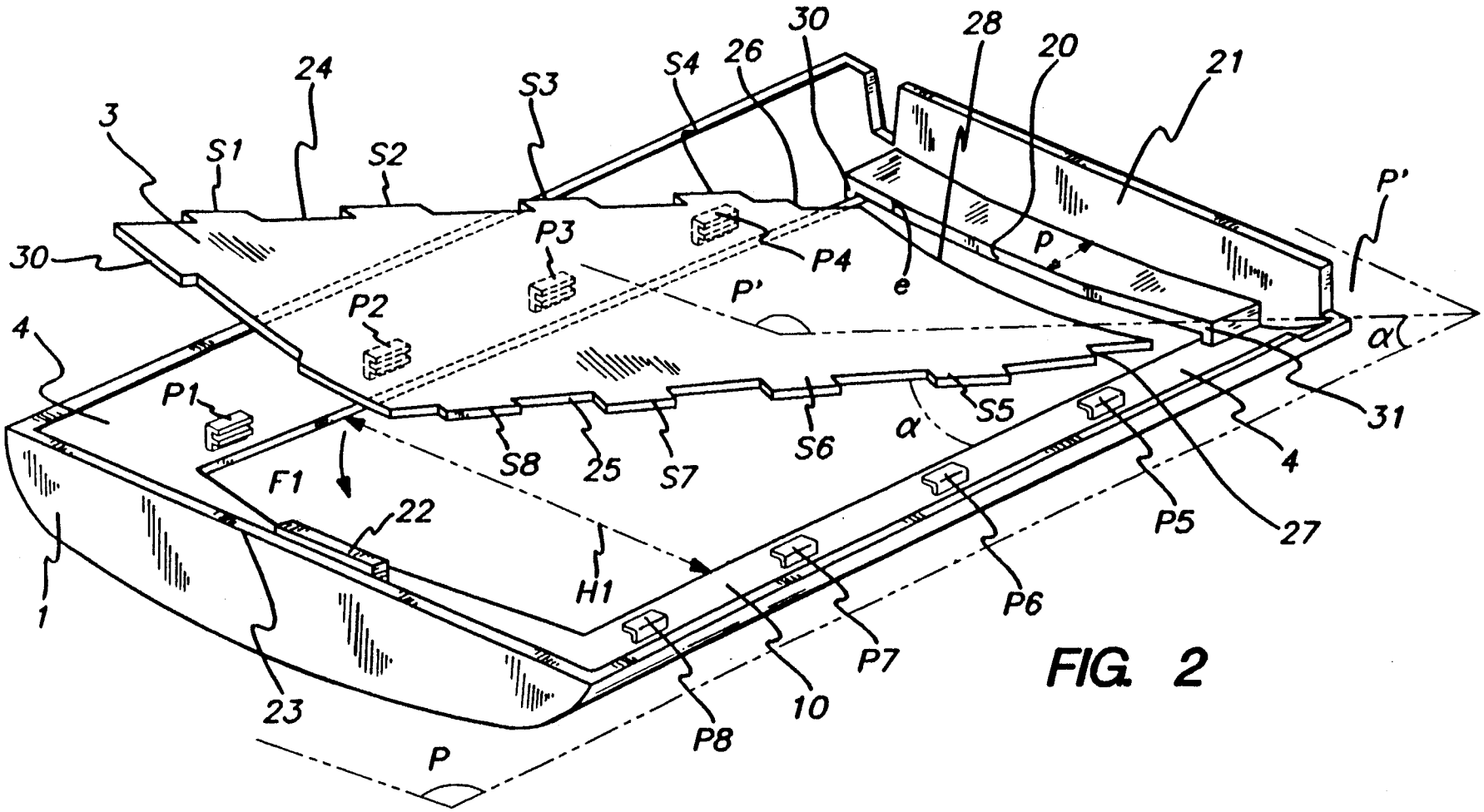
FIG. 2 shows in perspective the transparent plate of the door of the household electric oven according to the invention before its fitting on the inner edge of the shell of the door.

In FIG. 2, only the shell 1 and the transparent plate 3 are shown. The shell 1 comprises securement members constituted for example by eight holding tongues $P_1$, $P_2$, $P_3$, $P_4$, $P_5$, $P_6$, $P_7$ and $P_8$ arranged respectively on the two opposite sides 9 and 10 of the inner edge 4.

The number of holding tongues is in no way limiting. Other arrangements can be envisioned, the sole condition to be respected being the positioning of at least one holding tongue on each of the two opposed sides 9 and 10 of the internal edge 4.

The shell 1 also comprises, on one of the sides of its inner edge 4, a depression forming a recess 20 positioned on the transverse edge along one of the side walls 21 of the inner edge 4 of the shell 1 of a narrow width l and along all the length of the large opening of height $H_1$, the recess 20 having a depth e corresponding substantially to the thickness of the transparent plate 3 and a locking means, for example a small tongue 22 located substantially in the middle of the inner edge 4 of the side wall 23 opposite the side wall 21. Other locking means, for example a sheet mounted fixedly to an end on the inner edge and pivoting about this end so as to block, after rotation of the sheet, the movement of said plate (3), could be used.

The transparent plate 3 comprises, for example, eight projections $S_1$, $S_2$, $S_3$, $S_4$, $S_5$, $S_6$, $S_7$ and $S_8$ arranged respectively on the two opposite sides 24 and 25 of the transparent plate 3. The same remarks as for the holding tongues of the shell 1 apply to the projections of the transparent plate.

The projections are positioned on the transparent plate 3 so as to come, after fitting, into registry with the holding tongues.

Moreover, the transparent plate comprises two cut-outs 26 and 27 located in registry and positioned respectively on the ends of the opposite sides 24 and 25 of the plate 3 connected to the lateral sides 28 of the plate 3, and a cut-out 29 provided on the second lateral side 30 of the plate 3 and disposed opposite the small tongue 22, the small tongue 22 and the cut-out 29 constituting mutual blockage means of the transparent plate with respect to the shell.

The mounting of the transparent plate 3 on the shell 1 is effected in the following manner. The shell 1 is disposed in a plane P so as to expose its forward internal surface. The transparent plate 3 is positioned in a plane P' which makes an angle $\alpha$ with the plane P, the outwardly curved shape of the transparent plate 3 being positioned facing the forward internal surface of the shell 1. The free lateral side 28 in connection with the cut-outs 26 and 27 is disposed in registry with the side wall 21 of the shell 1 containing the cut-out 20 and comes to bear against the internal edge 4 of the shell 1. The lateral side 28 being in the indicated position, the transparent plate 3 effects a movement of rotation in the direction of arrow F.

Figure 3:
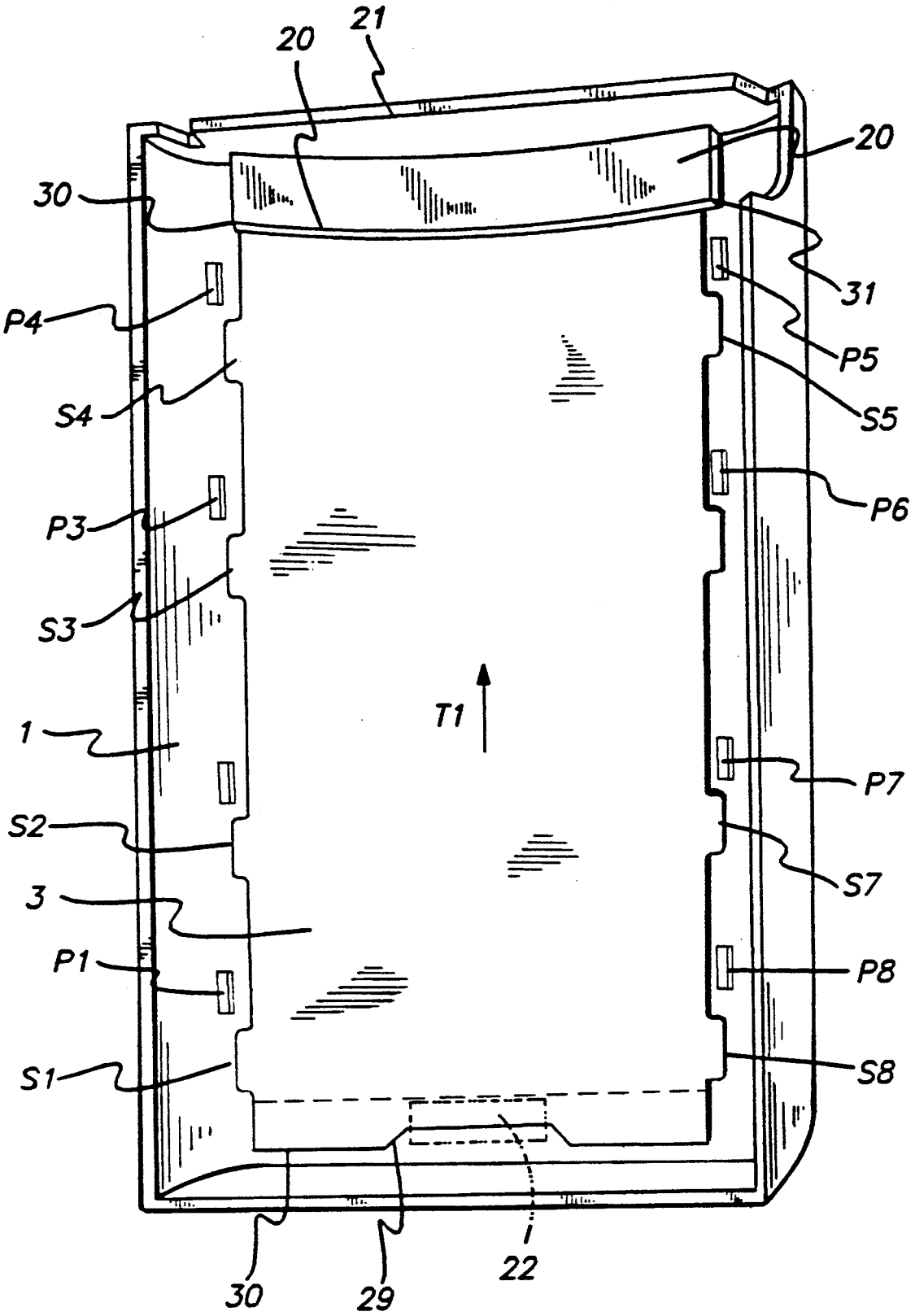
FIG. 3 shows the transparent plate of the door of the household electric oven according to the invention after its fitting in the recess of the inner edge of the shell of the door located on one of the lateral sides of the shell and before its positioning in a locked position.

As shown in FIG. 3, the rotation movement of the transparent plate 3 is through an angle—$\alpha$ such that the planes P and P' respectively of the shell 1 and of the transparent plate 3 will merge. The transparent plate 3 thus rests in part on the internal edge 4 of the shell 1. The projections S1 to S8 of the transparent plate 3 are disposed in the same alignment as the holding tongues P1 to P8 but in offset fashion. The transparent plate 3 is subjected to a translatory movement in the direction of arrow T1 such that the projections S1 to S8 of the transparent plate 3 fit in the recesses provided between the inner edge 4 and the holding tongues P1 to P8. The transparent plate 3 is thus located in the position shown in FIG. 4, the holding tongues P1 to P8 and the projections S1 to S8 being interengaged.

Figure 4:
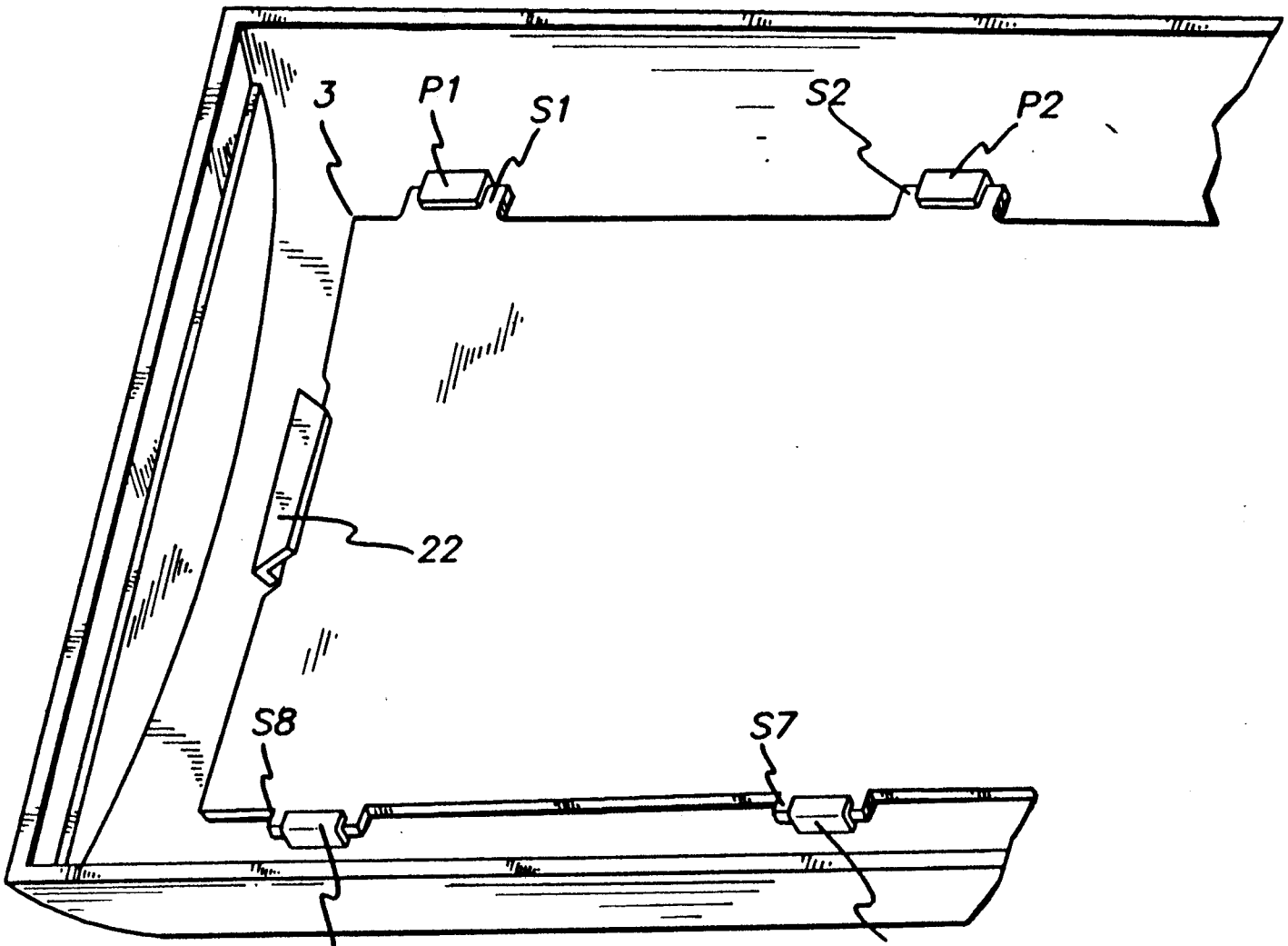
FIG. 4 shows the transparent plate of the door of a household electric oven after its locking by blocking means.

As shown in this same FIG. 4, the transparent plate 3 is shown in locked position, which is to say that the plate 3 cannot move in its mounting which is thus limited, on the one hand, by the small tongue 22, and, on the other hand, by the two cut-outs 26 and 27 coming into abutment against the edges 30 and 31 of the recess 20 shown in FIG. 2.

Figure 5A:
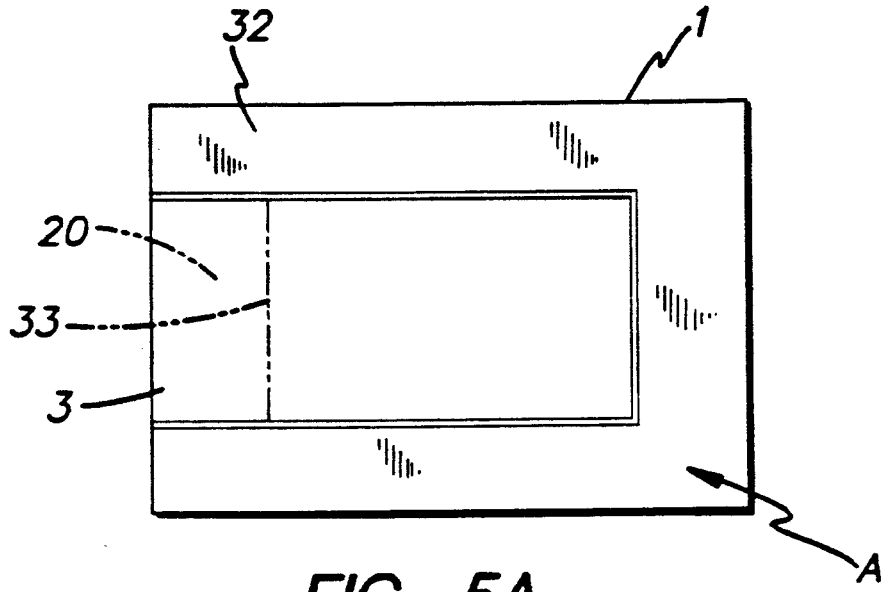
FIGS. 5*a* and 5*b* show the forward surfaces of the door of a household electric oven according to the invention.

As shown in FIG. 5*a*, the shell 1 of the household electric oven according to the invention has, on its forward surface A, an external border 32 having the general shape of a U lying on its side. The transparent plate 3 is mounted in the recess 20 provided for this purpose whose edge 33 is shown in broken lines.

Figure 5B:
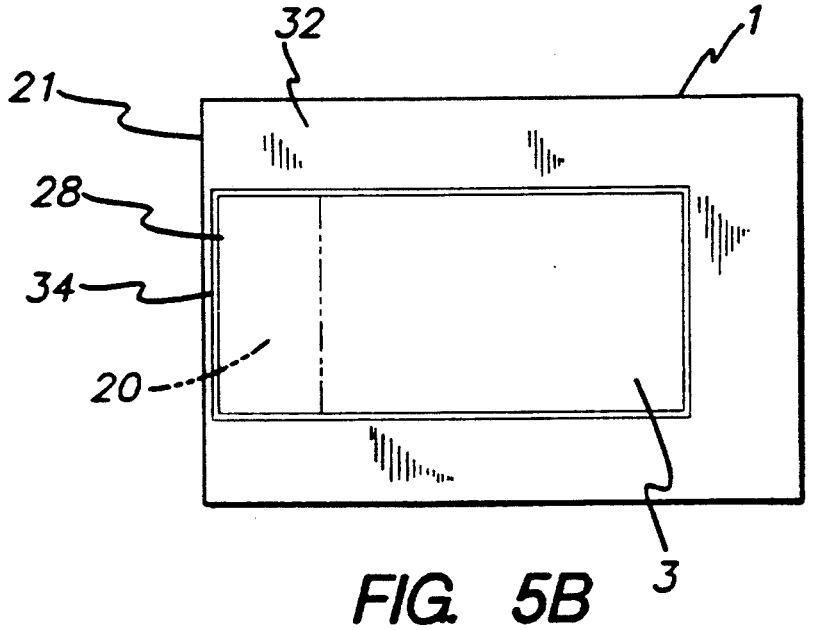

As shown in FIG. 5*b*, in another embodiment, the external border of the shell 1 of the oven having the same shape as that disclosed in FIG. 5*a*, has its opening located below the recess 20, which comprises a rib 34 comprising a joint for the lateral side 28 of the plate 3. The rib 34 has a height substantially equal to the depth e of the recess 20 and a length substantially equal to the height $H_1$ of the opening of the front wall 2 of the shell. This rib 34 whose upper edges are slightly rounded and of which the lateral side 28 of the plate 3 is no longer in prolongation of the side wall 21 of the internal edge 4 thanks to the joint thus formed, also permits obtaining a non-cutting edge of the side wall 21.

The invention is applicable to all household electric oven doors and more particularly to that of a microwave oven.

What is claimed is:

1. A door for a household electric oven, comprising a shell (1) of generally parallelepipedal shape whose forward wall (2) has a large opening (X) which has the general shape of a parallelogram and which is closed by a transparent plate (3) mounted on an inner edge (4) of the opening by means of securement members, said securement members being comprised by at least two holding tongues (7, 8) arranged respectively on two opposite sides (9, 10) of the inner edge (4) and each located at a distance from said inner edge so as to define a recess (5, 6) open in the direction of said opening, said transparent plate (3) having on its two opposite sides (24, 25), and parallel to the two sides bearing the tongues, at least two projections (5, 6) adapted to be secured by sliding of the plate (3) relative to the inner edge (4), respectively beneath the two holding tongues (7, 8), said inner edge (4) and said plate (3) including means for blocking said plate relative to said inner edge (4).

2. Door for a household electric oven according to claim 1, wherein the two opposite sides (9, 10) of the inner edge (4) of the shell (1) comprise a plurality of holding tongues ($P_1$, $P_2$, $P_3$, $P_4$, $P_5$, $P_6$, $P_7$, $P_8$) and in that the two opposite sides (24, 25) of the transparent plate (3) comprise an equal number of projections ($S_1$, $S_2$, $S_3$, $S_4$, $S_5$, $S_6$, $S_7$, $S_8$).

3. Door for a household electric oven according to claim 1, wherein the securement members further comprise a recess (20) of a height ($H_1$) corresponding to a lateral side of the forward opening of the shell (1) and located on the transverse edge along a side wall (21) of the inner edge (4) of the shell (1) to receive a free lateral side (28) of the transparent plate (3).

4. Door for a household electric oven according to claim 3, wherein the shell has an external border (32) having the general shape of a U lying on its side, whose opening located above the recess (20) comprises a rib (34) forming a joint for the free lateral side (28) of the plate (3).

5. Door according to claim 1, wherein the shell (1) and the transparent plate (3) have a section vertical and transverse to the sides (24, 25, 9, 10) carrying the projections ($S_1$, . . . $S_8$) and tongues ($P_1$, . . . $P_8$), of an outwardly rounded profile.

6. Door for a household electric oven according to claim 1, wherein the means for blocking the plate (3) relative to the inner edge (4) comprise two cut-outs (26 and 27) located in registry and positioned respectively on the ends of the opposed projection-bearing sides (24 and 25) of said plate (3) connected to a lateral side (28) of said plate (3) so as to come into abutment against the lateral side of a recess (20) of the shell (1) to block the sliding of said plate (3) relative to said inner edge (4) of said shell (1) in a first direction (T1), defined by the translatory movement that brings the holding tongues (7, 8) into engagement with the projections (5, 6), and a cut-out (29) located on another lateral side (30) of the plate (3) opposite to said lateral side (28), in registry with a small tongue (22) on a side wall (23) of said inner edge (4) opposite to said recess (20) so as to block the sliding of said plate (3) relative to said inner edge (4) of said shell (1) in a second direction (T2) opposite to said first direction (T1).

* * * * *